US010914487B2

(12) United States Patent
Gillmen et al.

(10) Patent No.: US 10,914,487 B2
(45) Date of Patent: Feb. 9, 2021

(54) LOW LOAD MODE OF HVAC SYSTEM

(71) Applicant: Johnson Controls Technology Company, Auburn Hills, MI (US)

(72) Inventors: David P. Gillmen, York, PA (US); Harold J. Dubensky, Lancaster, PA (US); Sandeep K. Chodapaneedi, Red Lion, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 79 days.

(21) Appl. No.: 16/186,107

(22) Filed: Nov. 9, 2018

(65) Prior Publication Data

US 2020/0132333 A1 Apr. 30, 2020

Related U.S. Application Data

(60) Provisional application No. 62/752,212, filed on Oct. 29, 2018.

(51) Int. Cl.

| | |
|---|---|
| ***F24F 11/86*** | (2018.01) |
| ***F24F 11/46*** | (2018.01) |
| ***F24F 11/65*** | (2018.01) |
| ***F24F 110/30*** | (2018.01) |
| ***F24F 140/50*** | (2018.01) |

(52) U.S. Cl.

CPC ..... *F24F 11/86* (2018.01); *F24F 11/46* (2018.01); *F24F 11/65* (2018.01); *F24F 2110/30* (2018.01); *F24F 2140/50* (2018.01)

(58) Field of Classification Search

CPC ..... F25B 2400/13; F25B 49/02; F25B 2400/075; F25B 2400/0751; F24F 11/86; F24F 11/46; F24F 11/65; F24F 2140/50; F24F 2110/30

See application file for complete search history.

(56) References Cited

U.S. PATENT DOCUMENTS

| | | | | |
|---|---|---|---|---|
| 5,101,639 | A | 4/1992 | Wruck et al. | |
| 9,080,778 | B2 | 7/2015 | Kawagoe et al. | |
| 9,317,045 | B2 | 4/2016 | Federspiel et al. | |
| 2008/0017040 | A1* | 1/2008 | Mileham | G01N 1/2211 96/413 |
| 2011/0113795 | A1* | 5/2011 | Montminy | F24F 1/022 62/77 |
| 2014/0069131 | A1 | 3/2014 | Masui | |
| 2015/0007595 | A1* | 1/2015 | Karkhanis | F25B 49/022 62/115 |
| 2016/0146522 | A1 | 5/2016 | Hung | |
| 2016/0238296 | A1* | 8/2016 | Saint Pierre | F25B 47/022 |

* cited by examiner

*Primary Examiner* — Marc E Norman
*Assistant Examiner* — Schyler S Sanks
(74) *Attorney, Agent, or Firm* — Fletcher Yoder, P.C.

(57) ABSTRACT

Embodiments of the present disclosure relate to a heating, ventilation, and/or air conditioning (HVAC) system that includes a first control configured to control a supply of power to a plurality of compressors based on an air flow through the HVAC system exceeding a first threshold, and a second control configured to supply power to a subset of compressors of the plurality of compressors based on the air flow through the HVAC system exceeding a second threshold while being below the first threshold.

26 Claims, 7 Drawing Sheets

LOW LOAD MODE OF HVAC SYSTEM

CROSS REFERENCE TO RELATED APPLICATIONS

This application claims priority from and the benefit of U.S. Provisional Application Ser. No. 62/752,212, entitled "LOW LOAD MODE OF HVAC SYSTEM", filed Oct. 29, 2018, which is hereby incorporated by reference in its entirety for all purposes.

BACKGROUND

The present disclosure relates generally to heating, ventilation, and/or air conditioning (HVAC) systems, and specifically, to a low load operating mode for HVAC systems.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to and ventilated from the environment. For example, an HVAC system may use a compressor to pressurize refrigerant flowing through the HVAC system. The compressor may be coupled to a motor configured to receive power from a power source. In some embodiments, the power source provides power to the motor when a desired amount of air flow through the HVAC system exceeds a threshold air flow rate. In this manner, the power source enables the HVAC system to condition and provide an air flow to a space when the threshold air flow rate is exceeded. However, when the desired air flow through the HVAC system does not exceed the threshold air flow rate, supply of power to the motor via the power source may be suspended, and the HVAC system may not condition the air flow.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a first control configured to control a supply of power to a plurality of compressors based on an air flow through the HVAC system exceeding a first threshold, and a second control configured to supply power to a subset of compressors of the plurality of compressors based on the air flow through the HVAC system exceeding a second threshold while being below the first threshold.

In another embodiment, a controller comprising a tangible, non-transitory, computer-readable medium comprising computer-executable instructions that, when executed, are configured to cause a processor to determine a configuration of a control of a heating, ventilation, and/or air conditioning (HVAC) system, in which the control is configured to enable power to be supplied to a plurality of compressors of the HVAC system in an activation configuration. The computer executable instructions, when executed, are also configured to cause the processor to determine whether a parameter indicative of an amount of air flow through the HVAC system is above a threshold and to operate the HVAC system in a low load mode, in which power is supplied to a subset of compressors of the plurality of compressors in response to a determination that the control is in a deactivation configuration and the parameter is above the threshold.

In one embodiment, a heating, ventilation, and/or air conditioning (HVAC) system includes a blower configured to direct an air flow through the HVAC system, a sensor system configured to determine a parameter indicative of an amount of the air flow passing through the blower, and a controller configured to enable a first amount of power to be supplied to a compressor of the HVAC system based on the amount of the air flow being above a first threshold value. The controller is also configured to enable a second amount of power to be supplied to the compressor based on the amount of the air flow being above a second threshold value and below the first threshold value.

DRAWINGS

Various aspects of this disclosure may be better understood upon reading the following detailed description and upon reference to the drawings in which.

DETAILED DESCRIPTION

Figure 1:
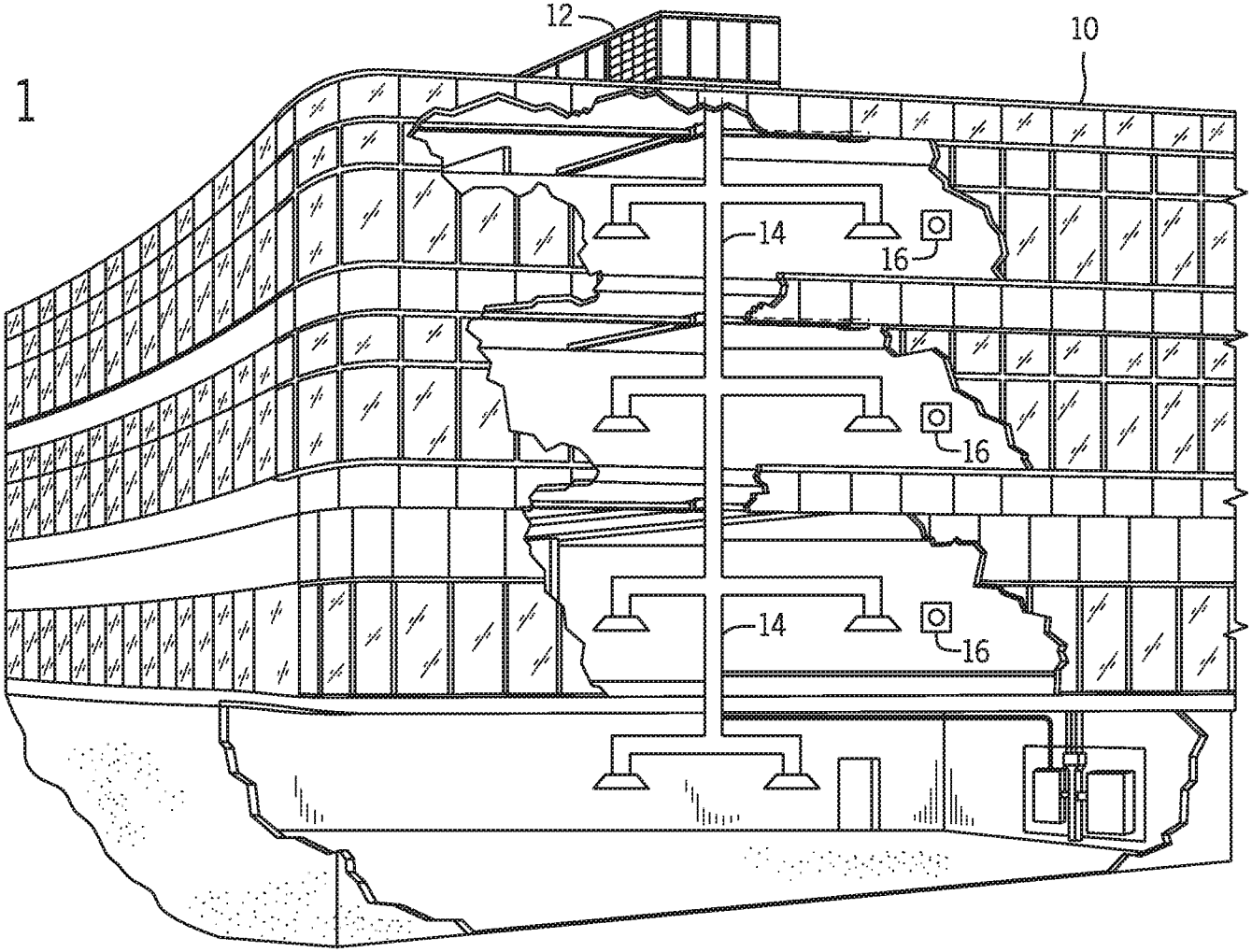
FIG. 1 is a schematic of an embodiment of an environmental control system for building environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to heating, ventilation, and/or air conditioning (HVAC) systems configured to operate and provide conditioning in a low load mode. As used herein, "conditioning" primarily refers to an operation in which the HVAC system cools an air flow and supplies the air flow to a conditioned space. However, it should be appreciated that the HVAC system may also be capable of operating to heat an air flow in a low load mode, in accordance with present embodiments. As discussed below, an amount of air flow directed through the HVAC system may determine an operating mode of the HVAC system. As an example, the HVAC system may include a control configured to transition between an activation position or configuration and a deactivation position or configuration. The control may be a switch, such as an air-proving switch, configured to be in the activation position when air flow passing through the HVAC system meets or exceeds a threshold air flow rate. When the switch is in the activation position, the switch enables the HVAC system to operate, such as via powering a compressor of the HVAC system, to condition the air flow and provide the air flow to a conditioned space. In traditional systems, when the switch is not activated, due to air flow through the HVAC system below the threshold air flow rate, the switch may block the HVAC system from operating to condition the air flow. For example, the deactivated switch may block operation of compressors of the HVAC system.

In certain instances, a low load mode of operation is desired for the HVAC system. As used herein, a low load mode of operation includes operation of the HVAC system when an amount of air flow passing through the HVAC system is below a particular threshold, such as the threshold air flow rate mentioned above. As will be appreciated, the air flow passing through the HVAC system may be below the threshold air flow rate when a demand for conditioning or "load" of the HVAC system is relatively low, such as during low occupancy of areas being conditioned by the HVAC system. However, a demand for conditioning, while low, may still exist. For example, the HVAC system may be implemented to provide a large amount conditioned air to serviced spaces, such as to large spaces or multiple spaces. However, when a smaller amount of conditioned air is desired, such as to a portion of a space or to a smaller number of spaces, a low rate air flow of the HVAC system may be desired to conserve energy used to operate the HVAC system. In such circumstances, the switch mentioned above may not be actuated, and therefore the HVAC system may be blocked from conditioning the air passing through the HVAC system. Therefore, air flow may be supplied to the conditioned space, but the air flow may not be conditioned by the HVAC system.

Thus, in accordance with certain embodiments of the present disclosure, it is presently recognized that operation of the HVAC system may be improved by providing a low load mode of operation, where air flow may be below a threshold air flow rate but where conditioned air is still desired to be provided to a conditioned space. For example, maintaining and/or modifying an operation of a compressor when lower amounts of conditioned air flow are desired may enable the HVAC system to satisfy a cooling demand, even when the air flow passing through the HVAC system is below a threshold air flow rate at which traditional devices, such as air-proving switches, are actuated to enable heating and/or cooling operation of the HVAC system. During the lower load mode of operation, at least one compressor of the HVAC system may receive power from a power source such that, during low load mode, the compressor may continue to operate and enable a cooling and/or heating operation of the HVAC system.

The operation of additional components may also be adjusted for the low load operating mode. For example, operation of certain HVAC system components may be adjusted to maintain a performance of the HVAC system in the low load mode and reduce component wear and degradation in the low load mode. As a result, the HVAC system is configured to properly and efficiently operate at a low load. Although this disclosure primarily discusses operating an HVAC in a low load mode based on an amount of air flow passing through the HVAC system, it should be appreciated that operating parameters, such as input power to a blower, may also determine proper HVAC system operation in the low load mode. As should be understood, this disclosure may be implemented in a variety of HVAC systems, such as packaged units, split systems, or any other suitable HVAC systems that may use a low load mode of operation.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as an integrated air handler that includes economizer, blowers, and/or an auxiliary heating unit and integrated condenser. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
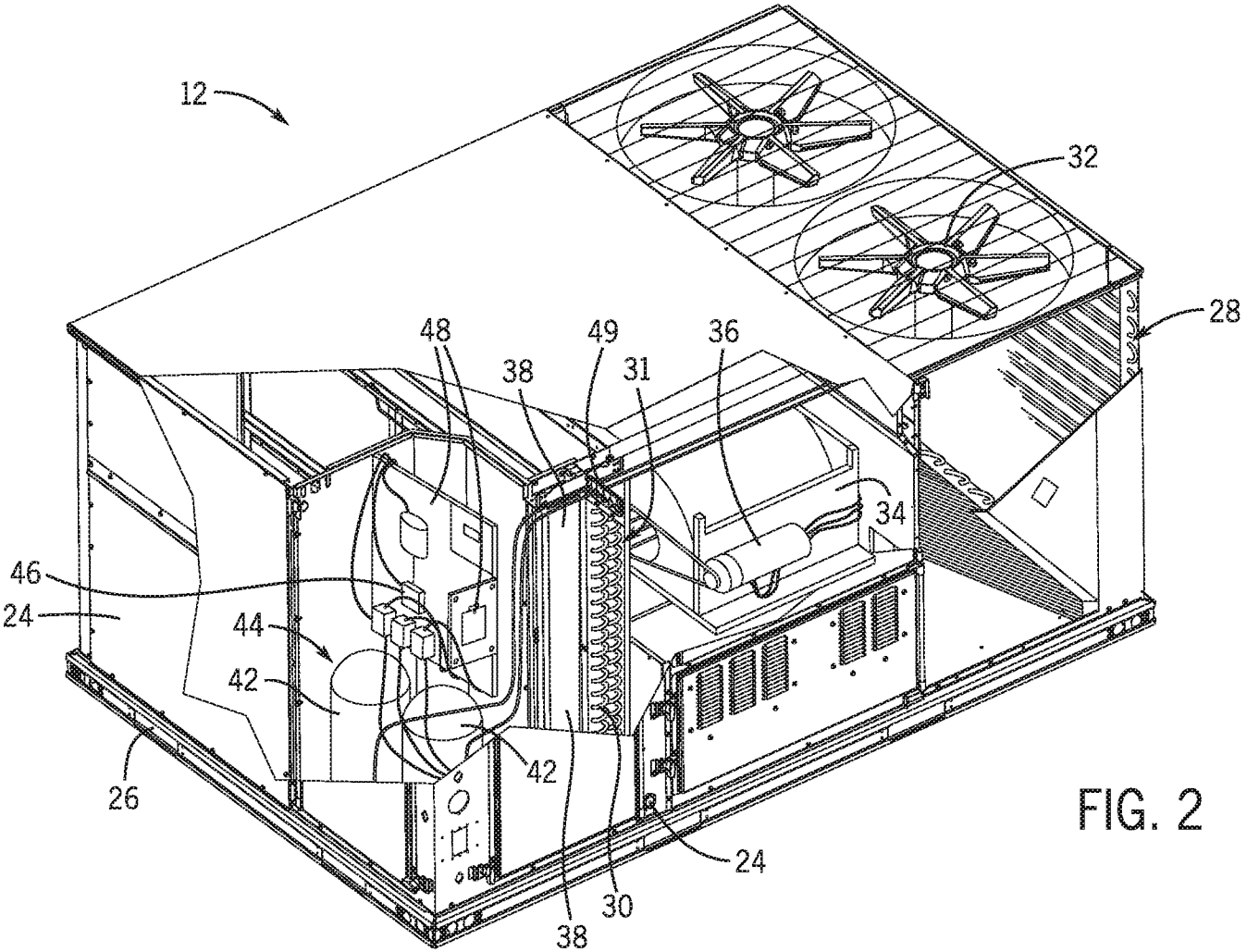
FIG. 2 is a perspective view of an embodiment of packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of conditioning functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of conditioning. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
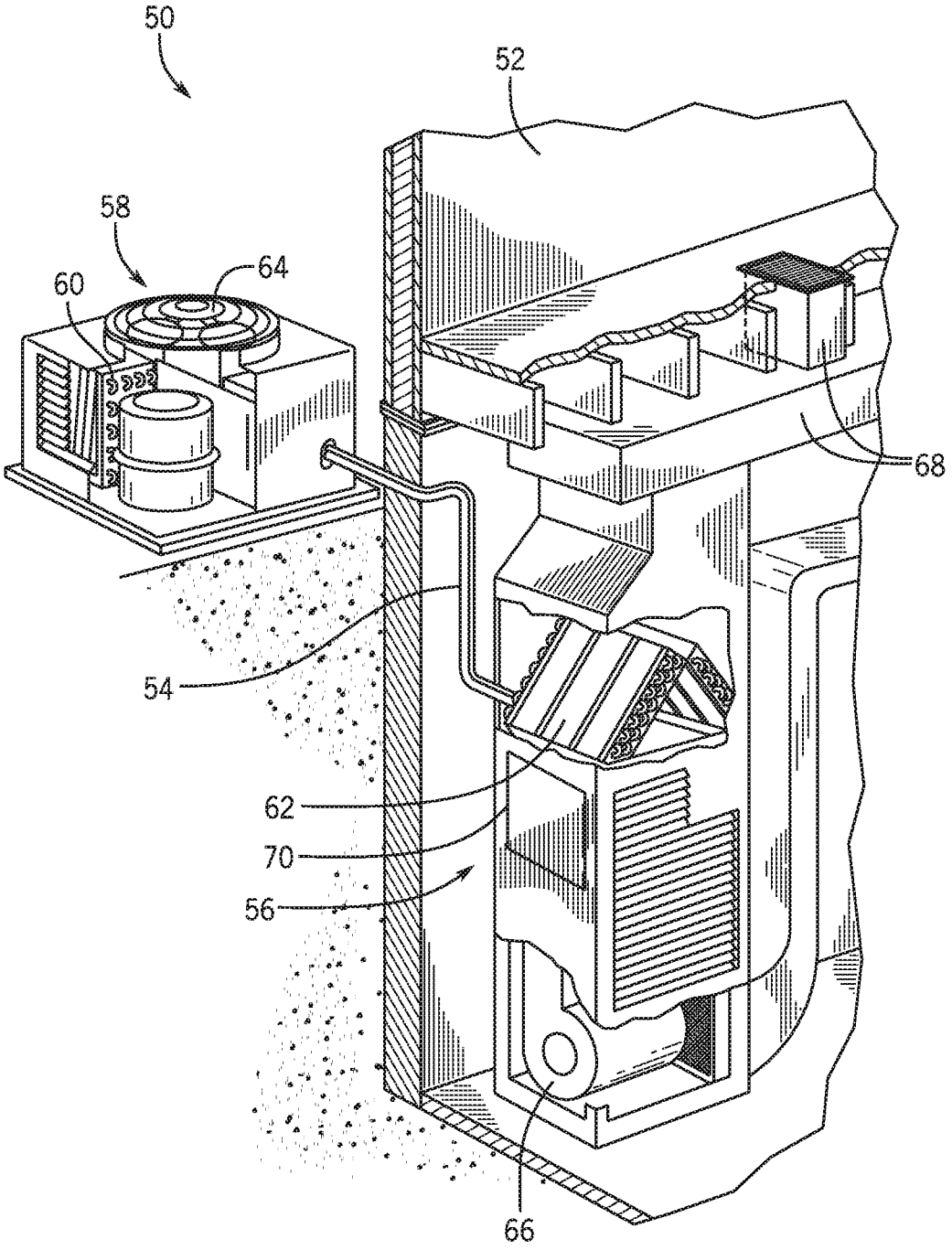
FIG. 3 is a schematic of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
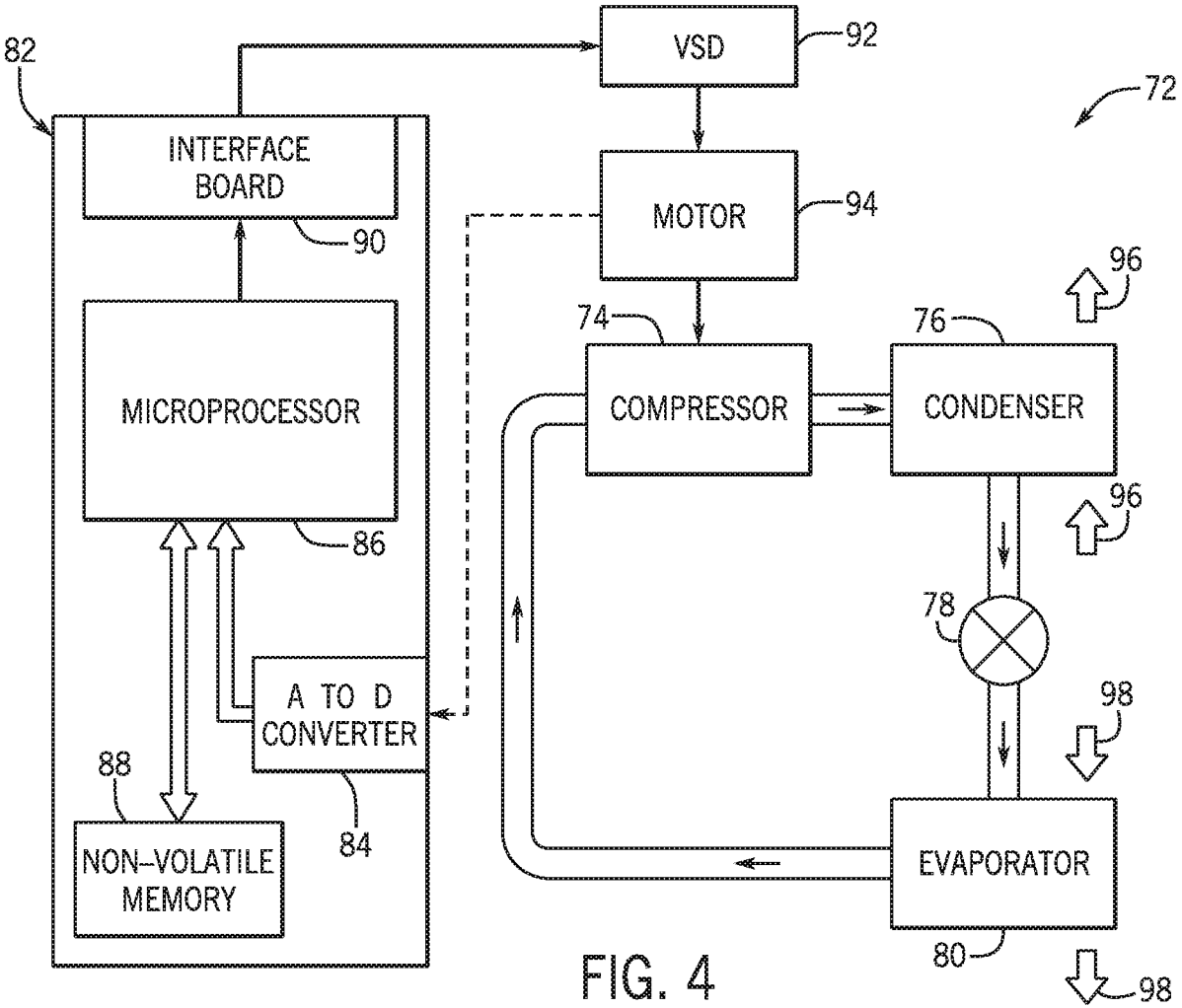
FIG. 4 is a schematic of an embodiment of a vapor compression system that can be used in any of the systems of FIGS. 1-3, in accordance with an aspect the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, conditioning operations, such as mechanical cooling, of an HVAC system, including any of the HVAC systems of FIGS. 1-4, may be based on a determination that an operating parameter of the HVAC system meets or exceeds a threshold level. For example, the operating parameter may be an amount of air flow passing through the HVAC system. In some embodiments, if the operating parameter meets or exceeds the threshold level, a device, such as an air-proving switch, is configured to enable or disable the conditioning operations of the HVAC system. For example, the air-proving switch may be configured to enable power supply to certain components, thereby enabling the components to operate and condition air flowing through the HVAC system. When the operating parameter is not above the threshold, such as in low load conditions, the device may disable supply of power to the components, and thus, operation of the components are disabled. However, in accordance with present embodiments, some components of the HVAC system may continue to operate in low load conditions, such that conditioning of the air flow is partially enabled. As a result, the HVAC system may continue to operate to cool and/or heat an air flow at a low load mode.

Figure 5:
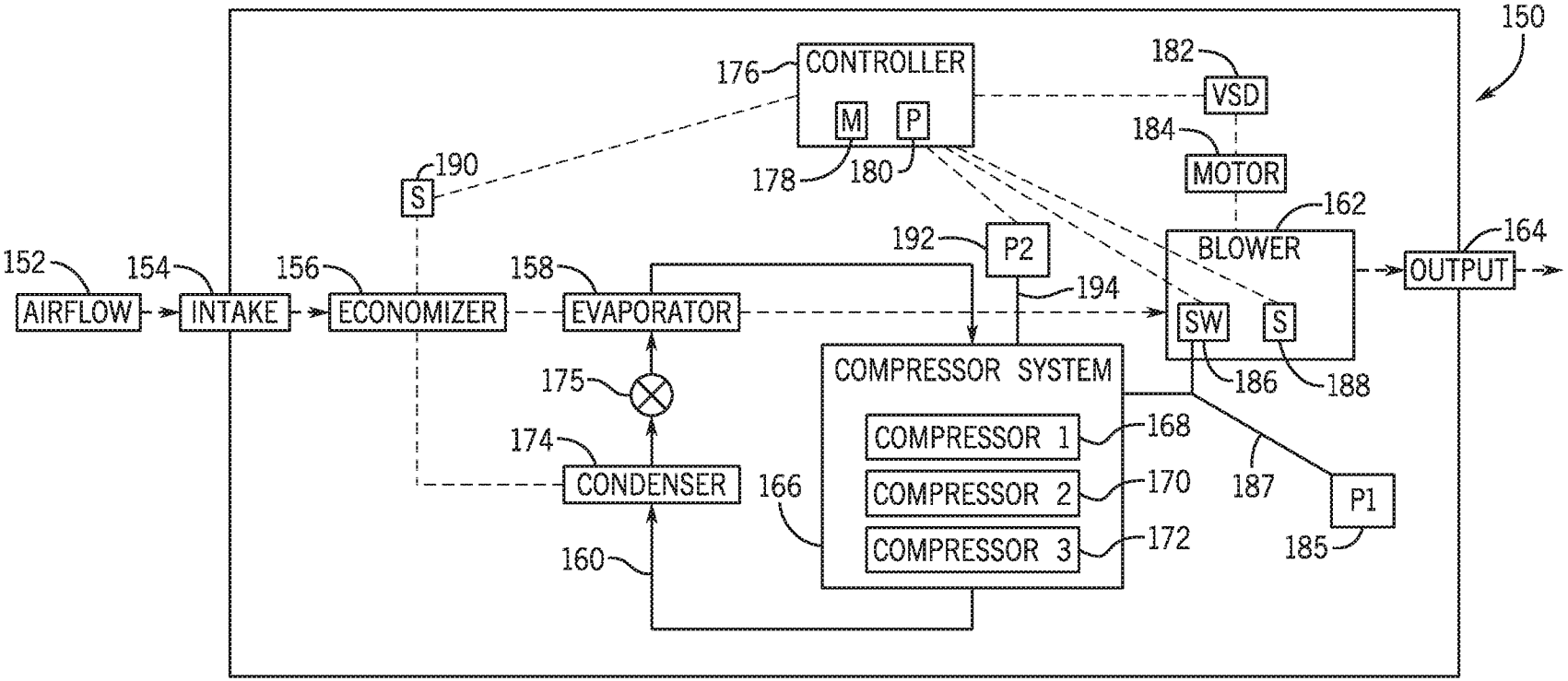
FIG. 5 is a schematic of an embodiment of an HVAC system configured to operate in a low load mode, in accordance with an aspect the present disclosure.

To illustrate an HVAC system capable of operating at a low load mode in accordance with present embodiments, FIG. 5 is a schematic of an HVAC system 150 configured to operate in a low load mode based on a level of an operating parameter. During conditioning, an air flow 152 flows through an intake 154 into the HVAC system 150. In certain embodiments, the intake 154 includes a fan configured to draw the air flow 152 from an ambient environment into the HVAC system 150. The air flow 152 may additionally or alternatively include return air received from a building or other space conditioned by the HVAC system 150.

In some embodiments, the HVAC system 150 includes an economizer 156 configured to pre-cool the air flow 152 after the air flow 152 enters the HVAC system 150. The economizer 156 may be configured to place the air flow 152 in thermal communication with a cold fluid, such as water and/or another air flow, in which the cold fluid absorbs heat from the air flow 152, such that the air flow 152 is cooled. In certain embodiments, the HVAC system 150 receives the air flow 152 from within a building and the economizer 156 circulates a cooling fluid cooled by an external environment outside of the building. Thus, the economizer 156 may be configured to operate when a temperature in the external environment is below a threshold value, such as below the temperature within the building, such that the cooling fluid is cooled by the external environment below a temperature of the air flow 152. As a result, the cooling fluid may effectively remove heat from the air flow 152 in the economizer 156. As an example, the economizer 156 may be coupled to a cooling tower configured to cool the cooling fluid via the temperature of the external environment. In certain embodiments, if the temperature of the external environment is not below the particular threshold value, the air flow 152 may still be directed through the economizer 156. However, operation of the economizer 156 may be disabled. That is, the cooling fluid may not be directed through the economizer 156.

The economizer 156 may direct the air flow 152 across an evaporator 158 configured to place the air flow 152 in thermal communication with a refrigerant flowing through a refrigerant circuit 160 of the HVAC system 150. In the evaporator 158, the refrigerant absorbs heat from the air flow 152 to further cool the air flow 152. The cooled air flow 152 is then directed out of the evaporator 158 to a blower 162 configured to direct the air flow 152 to an output 164 out of the HVAC system 150. In certain embodiments, the air flow 152 exits the HVAC system 150 through the output 164 to ducts, tubing, piping, another suitable component, or any combination thereof, configured to direct the air flow 152 to spaces serviced by the HVAC system 150. The blower 162 may also configured to increase a speed of the air flow 152, such that the air flow 152 is able to flow to the areas at a sufficient rate.

Meanwhile, the refrigerant flows through the refrigerant circuit 160 during operation of the HVAC system 150. As mentioned, the refrigerant flows through the evaporator 158 to absorb heat from the air flow 152. As a result, the refrigerant is heated and increases in temperature. The heated refrigerant flows through a compressor system 166 configured to pressurize the refrigerant. As illustrated by FIG. 5, the compressor system 166 may include several compressors, such as a first compressor 168, a second compressor 170, and a third compressor 172. In some embodiments, the first compressor 168, the second compressor 170, and the third compressor 172 are positioned in a parallel configuration within the refrigerant circuit 160. That is, a portion of the refrigerant may flow through the first compressor 168 while another portion of the refrigerant concurrently flows through the second compressor 170, and a remainder of the refrigerant concurrently flows through the third compressor 172. The compressors 168, 170, and 172 may each independently pressurize the respective flows of refrigerant to further increase the pressure and temperature of the refrigerant.

After being pressurized via the compressor system 166, the refrigerant flows to a condenser 174 configured to remove heat from the refrigerant. In certain embodiments, the condenser 174 is in thermal communication with the economizer 156. That is, the economizer 156 may place cold fluid in thermal communication with the heated refrigerant in the condenser 174. Additionally or alternatively, the condenser 174 may remove heat from the refrigerant via fans or other components. For example, fans may force ambient air across the condenser 174, and the ambient air may absorb heat from the refrigerant in order to cool and condense the refrigerant. In some embodiments, the HVAC system 150 may include an expansion valve 175 between the condenser 174 and the evaporator 158. The expansion valve 175 may operate to reduce a pressure of the refrigerant, thereby expanding the refrigerant and further cooling the refrigerant. After being cooled, the refrigerant returns to the evaporator 158 to remove heat from the air flow 152.

In some embodiments, the HVAC system 150 may also be configured to heat the air flow 152. During heating, the HVAC system 150 may operate in a manner similar to the cooling operation described above. However, the air flow 152 may be heated prior to flowing through the output 164. For example, the HVAC system 150 may include an additional heat exchanging unit adjacent to the outlet 164 configured to add heat to the air flow 152. The additional heat exchanging unit may place the air flow 152 in thermal communication with a hot fluid, such as steam. In another embodiment, the HVAC system 150 may operate as a heat pump, and the refrigerant may flow through the refrigerant circuit 160 in a reverse order to that described above. In such an embodiment, the condenser 174 may function as an evaporator, and the evaporator 158 may function as a condenser to heat the air flow 152

To operate the HVAC system 150, a controller 176 may be in communication with components of the HVAC system 150. For example, the controller 176 may control the operation of the compressor system 166 to pressurize the refrigerant to a certain pressure. The controller 176 may further be in communication with the economizer 156 to determine if the economizer 156 should pre-cool the air flow 152 and/or cool the refrigerant in the condenser 174. The controller 176 may include a memory 178 and a processor 180. The memory 178 may be a mass storage device, a flash memory device, removable memory, or any other non-transitory computer-readable medium that includes instructions for the processor 180 to execute. The memory 178 may also include volatile memory such as randomly accessible memory (RAM) and/or non-volatile memory such as hard disc memory, flash memory, and/or other suitable memory formats. The processor 180 may execute the instructions stored in the memory 178, in order to adjust operation of the components of the HVAC system 150.

As noted, in some embodiments of the HVAC system 150, a conditioning operation, such as via the refrigerant circuit 160, may be based on certain operating parameters. As used herein, "based on" includes embodiments in which the conditioning operation is based at least on the operating parameters. For example, the HVAC system 150 may monitor an amount or rate of the air flow 152 passing into and/or through the HVAC system 150 to determine if conditioning operations, such as operation of components of the refrigerant circuit 160, should be enabled. In certain embodiments, the controller 176 is configured to adjust the amount of the air flow 152 flowing through the HVAC system 150. The controller 176 may be communicatively coupled to a VSD 182 configured to change an operating speed of a motor 184 coupled to the blower 162. By adjusting operation of the VSD 182, the controller 176 is able to adjust the operating speed of the motor 184, which adjusts a rate of the air flow 152 directed through the blower 162 out of the HVAC system 150. That is, a higher speed of the motor 184 results in a higher rate and a higher amount of air flow 152 directed through the blower 162, and a lower speed of the motor 184 results in a lower rate and a lower amount of air flow 152 directed through the blower 162.

The HVAC system 150 may include a first power source 185 configured to supply power to certain components of the HVAC system 150, such as the compressor system 166. The HVAC system 150 may also include a switch 186 configured to enable or block power provided to the certain components of the HVAC system 150. For example, the switch 186 is configured to enable power to be provided by the first power source 185 to any of the compressors 168, 170, and 172 to power the compressor system 166. For purposes of discussion, this disclosure primarily refers to the switch 186 as disposed on a first circuit 187, which may be a form of an electrical circuit, in which the switch 186 may be configured to regulate the power supply to the compressor system 166 by the first power source 185 via the first circuit 187. However, it should be understood that the switch 186 may additionally or alternatively be a different type of control, such as a controller, a valve, or another suitable component, configured to enable the first power source 185 to supply power to the compressor system 166. The switch 186 may transition between an activation position and a deactivation position based on a particular operating parameter of the HVAC system 150. In some embodiments, the switch 186 is an air proving switch disposed on or proximate the blower 162 and is configured to adjust between the activation position and the deactivation position based on a pressure differential across the blower 162, where the pressure differential is indicative of the amount of air flowing through the blower 162. In certain embodiments, when the pressure differential is above a threshold, the switch 186 may be in the activation position, such as a closed position. That is, when the pressure differential is exceeds a certain amount, the switch may be physically forced or driven into the activation position. Additionally or alternatively, the switch 186 may be communicatively coupled to a sensing component configured to measure the amount of air flow 152, in which the switch may transition to the activation position based on the amount of air flow 152 measured by the sensing component. In response to the switch 186 being in the activation position, power may be provided to the compressor system 166. However, when the pressure differential is below the threshold, the switch 186 may be driven, forced, or otherwise transition to a deactivation position, such as an open position. As a result, power may be blocked or prevented from being provided to the compressor system 166 through the first circuit 187. The switch 186 may be communicatively coupled to the controller 176, such that the controller 176 determines the position of the switch 186, and the controller 176 may adjust operation of the HVAC system 150, including operation of the compressor system 166, accordingly.

In some embodiments, a sensor 188 may be used to measure an operating parameter of the HVAC system 150 to determine or regulate operation of the HVAC system 150. For example, the sensor 188 maybe be disposed on or proximate the blower 162 to determine the amount of air flowing through the blower 162. As an example, the sensor 188 may be a static pressure switch and/or a piezometer configured to determine the pressure differential across the blower 162, a speed of the air flow 152 flowing through the blower 162, a temperature of the air flow 152 in the blower 162, another parameter, or any combination thereof. In another embodiment, the sensor 188 may be configured to determine a voltage inputted to the VSD 182, which corresponds to a desired operation of the HVAC system 150. That is, the voltage measured by the sensor 188 may be correlated with amount of air flowing through the blower 162. By determining such parameters, the rate of the air flow 152 passing through the HVAC system 150 may be monitored, and operation of the HVAC system 150 may be controlled or adjusted accordingly.

Moreover, the HVAC system 150 may include other sensors. By way of example, a sensor 190 may be disposed near the intake 154, such as at the economizer 156, to detect a temperature of ambient air, return air, and/or a temperature of the air flow 152 entering the intake 154. In some embodiments, the sensor 190 is configured to detect a mixed air temperature or a temperature of an air flow that includes both the ambient air, the return air, and/or the air flow 152. By using the detected ambient temperature, the controller 176 may determine whether the economizer 156 should be operated to pre-cool the air flow 152. Other sensors may also be disposed in the HVAC system 150. For example, sensors may be disposed downstream of the output 164 to determine a temperature of the air flow 152 exiting the HVAC system 150 or a pressure in the ducts, tubing, or piping coupled to the HVAC system 150. It should be appreciated that other sensors not mentioned may also be used for the HVAC system 150 to adjust operations of the system components.

As described, when the amount or rate of the air flow 152 is below a threshold value, the switch 186 may be in the deactivation position, such that power is not provided to the compressor system 166. In some embodiments, the switch 186 may be configured to provide enable power to be provided to some of the compressors 168, 170, and 172, such as some or all of the first compressor 168, the second compressor 170, and/or the third compressor 172. As such, when the switch 186 is in the deactivation position, the first compressor 168, the second compressor 170, and/or the third compressor 172 may not receive power from the first power source 185. Instead, some or all of the first compressor 168, the second compressor 170, and/or the third compressor 172 may receive power when the switch 186 is in the activation position.

However, in accordance with present embodiments, a subset of the compressors 168, 170, 172 may receive power from a second power source 192 when the switch 186 is in the deactivation position. The second power source 192 may supply power to the subset of compressors 168, 170, 172 via a second circuit 194. In some embodiments, a portion of the first circuit 192 is shared with the second circuit 194 and thus, the first circuit 192 and the second circuit 194 may be considered a part of the same circuit. In any case, the second circuit 194 enables power to be provided by the second power source to the subset of compressors 168, 170, 172. As such, the second power source 192 enables the HVAC system 150 to operate in a low load operation mode. In other words, when the amount of air flow 152 is low and below the threshold value at which the switch 186 transitions to the activation position, the controller 176 may still operate at least one of the first compressor 168, the second compressor 170, and/or the third compressor 172. In this manner, the switch 186 may be considered a first control configured to control a supply of power to each of the compressors 168, 170, 172 when the amount of air flow 152 is above the threshold value. Additionally, the controller 176 may be considered a second control configured to supply power to the subset of compressors 168, 170, 172 when the amount of air flow 152 is below the threshold value, such as based on the position or configuration of the switch 186. Additionally or alternatively, the switch 186 may be considered a sensor system of the HVAC system 150 configured to determine the amount of air flow 152 passing through the blower 162. The controller 176 may operate at least one of the first compressor 168, the second compressor 170, and/or the third compressor 172 based on the amount of air flow 152 as indicated by the switch 186. That is, the controller 176 may be configured to determine if the amount of air flow 152 is below the threshold value based on the switch 186, such as based on the position of the switch 186 and/or based on a measurement of the amount of air flow 152 detected by the switch 186, such as a sensing component of the switch 186.

As discussed above, in certain circumstances, a load on the HVAC system 150 may be relatively low, which may result in a low rate of air flow 152 provided by the HVAC system 150. Nevertheless, in such circumstances, it may still be desirable for the HVAC system 150 to perform cooling and/or heating operations so that the air flow 152 is conditioned to satisfy the cooling and/or heating demand. In some embodiments, the operation of one of the compressors is adjusted to operate according to low load parameters when the HVAC system 150 is operating in the low load mode, which may improve operation of the HVAC system 150 and/or protect HVAC system 150 components from wear and degradation.

It should be appreciated that, although FIG. 5 illustrates three compressors, there may be any amount of compressors included in the HVAC system 150. Indeed, the switch 186 may be used to regulate operation of any suitable number of the compressors of the compressor system 166. For example, in certain embodiments, the compressor system 166 may include a single variable capacity compressor. When the amount of air flow 152 is above the threshold value, such as when the switch 186 is in the activation position, the controller may provide a first amount of power, such as via the first power source 185, to the variable capacity compressor to operate the variable capacity compressor at a first capacity, which may be considered a maximum capacity. When the amount of air flow 152 is below the threshold value, such as when the switch 186 is in the deactivation position, the controller 176 may provide a second amount of power to the variable capacity compressor. For example, the controller 176 may suspend the first power source 185 in providing power to the variable capacity compressor and operate the second power source 192 to provide a second amount of power to the variable capacity compressor while the switch 186 is in the deactivation position. Additionally or alternatively, the controller 176 may adjust operation of the first power source 185 to provide the second amount of power to the variable capacity compressor. In any case, the second amount of power may enable the variable capacity compressor to operate at a second capacity, which may be a percentage of the first capacity.

In further embodiments, the switch 186 may be coupled to other components of the HVAC system 150. In this manner, the switch 186 may enable and block power to be provided to the other components. It should also be understood that the HVAC system 150 may also include components not already mentioned, such as additional components disposed along the refrigerant circuit 160 to enhance performance of the HVAC system 150.

Figure 6:
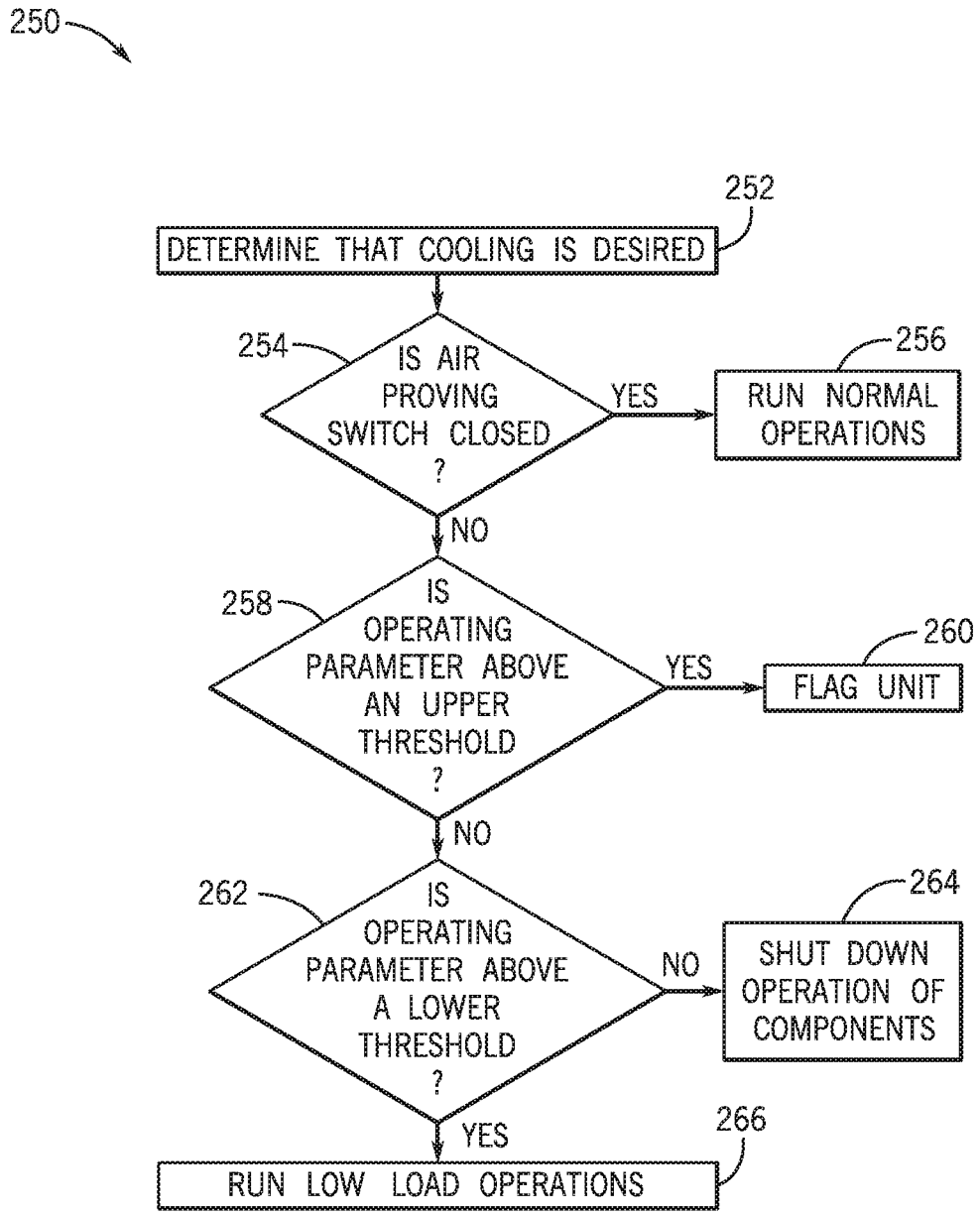
FIG. 6 is a flow chart of an embodiment of a method for an HVAC system to determine when to operate in the low load mode, in accordance with an aspect the present disclosure.

To illustrate operation of the HVAC system 150 in accordance with present embodiments, FIG. 6 illustrates a flowchart of a method 250 for determining whether the HVAC system 150 should operate in a low load mode. At block 252, the HVAC system determines that cooling is desired. That is, it is determined that cooling is desired for the areas conditioned by the HVAC system 150. In some embodiments, the cooling operation is determined based on temperatures detected via the sensors of the HVAC system 150. For example, the HVAC systems 150 may be configured to operate in a cooling mode when a mixed air temperature, which may include return air from a space conditioned by the HVAC system 150 mixed with air from an external environment, detected by the sensor 190 is above a certain temperature threshold, such as 20° C.

After determining that cooling is desired, the blower 162 of the HVAC system 150 may operate to provide air flow 152 to the space conditioned by the HVAC system 150. The rate at which the air flow 152 is supplied may be based on a desired temperature within the conditioned space, a desired temperature of the air flow 152 at the outlet 164, a user input, another suitable operating parameter, or any combination thereof. As described above, based on an amount of air flow 152 passing through the blower 162 and/or an amount of voltage supplied to the VSD 182, the switch 186 is configured to be in either an activation position or a deactivation position. At block 254, the configuration of the switch 186, which may be an air-proving switch or other type of control, is used by the HVAC system 150 to determine the operation of the HVAC system 150. In accordance with present embodiments, the HVAC system 150 is configured to enable heating and/or cooling of the air flow 152 when the switch 186 is in both activation and deactivation positions.

If the switch 186 is in the activation position, the HVAC system 150 is configured to operate at normal heating and/or cooling operations, as shown at block 256. As discussed above, the activation position of the switch 186 results in a supply of power being provided to components, such as the compressor system 166 via the first power source 185, for the HVAC system 150 to operate in a normal operating mode. During a normal operating mode, components of the HVAC system 150 provide normal heating and/or cooling capabilities and operations. That is, the components of the HVAC system 150 may operate similarly to traditional systems to provide heating and/or cooling to the air flow 152.

If the switch 186 is in the deactivation position, power may be supplied to certain components of the HVAC system 150, such as via the second power source 192, but not to other components of the HVAC system 150. As discussed, for example, certain compressors 168, 170, and/or 172 may not receive power when the switch 186 is in the deactivation position. However, air may still flow through the HVAC system 150 while the switch 186 is in the deactivation position, and a cooling or heating demand may still exist. To determine if a low load mode of operation is to be implemented, one or more operating parameters of the HVAC system 150 may be monitored and/or compared to threshold values. For example, the operating parameter may be an amount of the air flow 152 passing through the blower 162, a voltage supplied to the VSD 182, or other suitable parameter of the HVAC system 150.

First, as indicated at block 258, a determination is made regarding whether the operating parameter is above a threshold, which may be an upper threshold. As previously noted, the operating parameter may be an amount of the air flow 152 provided by the blower 162 and/or an amount of voltage supplied to the VSD 182. In some embodiments, the upper threshold is a percentage of a maximum possible value of the operating parameter possible during operation of the HVAC system 150. For example, the upper threshold may be 60% of a maximum air flow volume or 60% of a maximum voltage supplied to the VSD 182. In additional or alternative embodiments, the upper threshold is a particular value, which may be a volume of air flowing through the blower 162, such as 2000 cubic feet per minute (56.6 cubic meters per minute). The upper threshold may be adjustable. For example, user input may adjust the upper threshold between certain ranges, such as between 50% and 95% of a maximum air flow volume or maximum voltage. Additionally or alternatively, the upper threshold may be set based on particular operating parameters, such as based on historical data of the amount of air flow 152 and/or of the voltage input to the VSD 182 during operation of the HVAC system 150.

If the operating parameter is above the upper threshold, the HVAC system 150 may be flagged, as shown at block 260. That is, when the operating parameter is above the upper threshold and the switch 186 is in the deactivation position, the HVAC system 150 may generate a flag identifier for servicing. The flag identifier may include an indicator, such as a light, to indicate that the HVAC system 150 is to be further examined. As discussed, when the switch 186 is in the deactivation position, regular heating and/or cooling operations may not be functional. Normally, the switch 186 is configured to transition to the activation position when the operating parameter, such as air flow rate, is above the upper threshold. As such, if the switch 186 remains in the deactivation position when the air flow rate is above the upper threshold, performance of certain components of the HVAC system 150 may not be as desired. Therefore, the HVAC system 150 may be flagged for maintenance purposes to enable further examination of the components of the HVAC system 150. Indeed, in some embodiments, the HVAC system 150 may be shut down when the HVAC system 150 is flagged.

If the operating parameter is below the upper threshold, the method 250 proceeds to block 262. Specifically, in some embodiments, it may be further determined whether the operating parameter is operating above or below a lower threshold that is less than the upper threshold, as indicated at block 262. For example, a measurement of the air flow, such as detected by the switch 186 and/or a sensor of the HVAC system 150, may be compared to the lower threshold. The lower threshold may be used to determine whether a certain amount of air flow is desired and whether cooling and/or heating capabilities are appropriate. In certain embodiments, the lower threshold may be based at least in part on system capabilities, such as specifications of the compressor system 166, and/or based on user input. Similar to the upper threshold, the lower threshold may be a particular value, such as 30 cubic meters per minute and/or a percentage, such as 40% of a maximum possible amount of the operating parameter during operation of the HVAC system 150.

If the operating parameter is not above the lower threshold, as shown at block 264, operations of certain components of the HVAC system 150 may be shut down, such that the HVAC system 150 operates in a disabled mode. As an example, operation of the compressor system 166, the evaporator 158, and/or the condenser 174 may be shut down. In this manner, the cooling and/or heating operations of the HVAC system 150 may be suspended. However, in some embodiments, certain components of the HVAC system 150, such as the blower 162, may still continue to operate. For example, the blower 162 may continue to operate to provide air to the space conditioned by the HVAC system 150 and/or to circulate air through the HVAC system 150.

If the operating parameter is determined to be above the lower threshold, the HVAC system 150 may proceed to operate in a low load mode, as shown at block 266. In the low load mode of operation, operations of certain components of the HVAC system 150 are adjusted to increase an efficiency of the HVAC system 150, while avoiding placing undesired stress on the components. Additionally, certain parameters are monitored to determine that operating conditions of the HVAC system 150 remain suitable to operate at the low load mode. Such conditions may further indicate that the components of the HVAC system 150 may operate without encountering undesired stress.

Although the method 250 is illustrated and described in the context of a call for cooling, in some embodiments, the method 250 may be incorporated with a call for heating of the HVAC system 150. During heating conditions, the step described at block 252 may instead determine that heating is desired. In some embodiments, heating is determined when the mixed air temperature detected by the sensor 190 is below a particular temperature, such as 2° F. (1.1° C.) below the mixed air temperature for cooling, or 19° C. However, the steps described at blocks 254-266 may be substantially the same after the determination that heating is desired.

Figure 7:
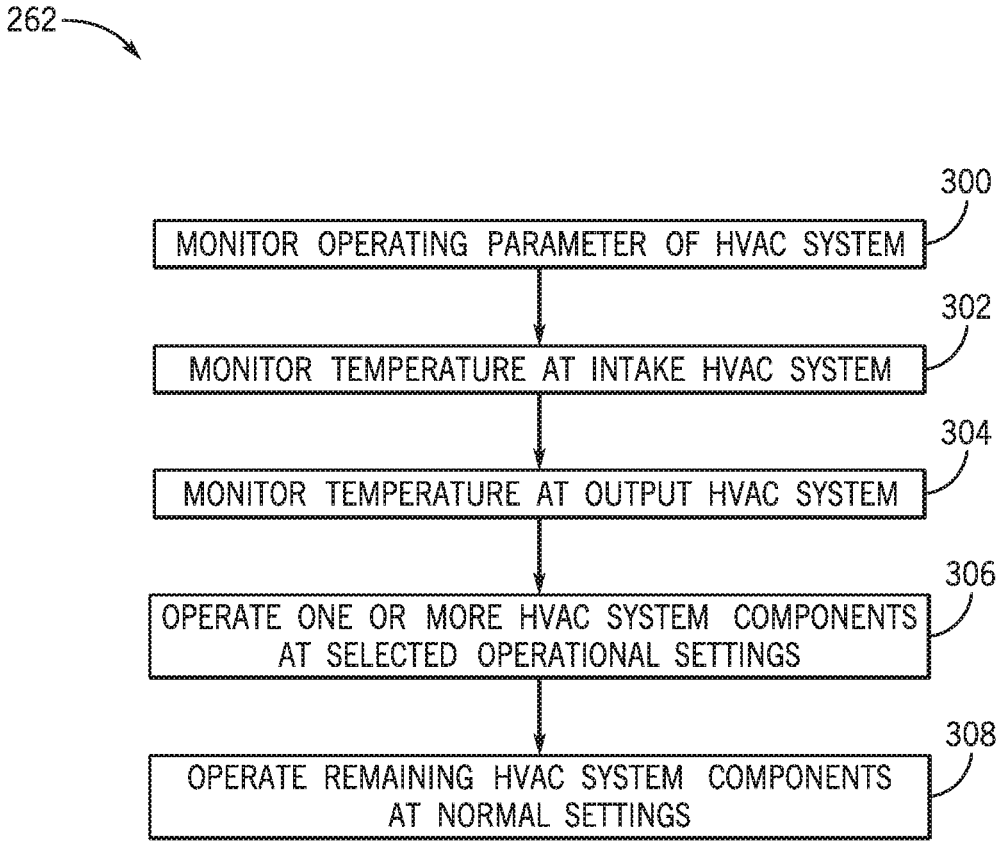
FIG. 7 is a flow chart of an embodiment of a method for an HVAC system to operate in the low load mode, in accordance with an aspect the present disclosure.

To further describe the low load mode of operation, FIG. 7 is a block diagram illustrating a detailed embodiment of block 262 in FIG. 6, including particular operations that may be performed during low load mode of operation. Such operations may enable the HVAC system 150 to operate efficiently and/or without placing undesired stress on components of the HVAC system 150. At block 300 of the illustrated embodiment, the operating parameter of the HVAC system 150 is monitored. As mentioned, the operation of the HVAC system 150 may be determined based on whether the operating parameter is above or below an upper threshold and/or a lower threshold. Thus, the operating parameter may be monitored to determine whether the operating parameter is between the lower threshold and the upper threshold. As discussed above, if the operating parameter is within the upper and lower threshold values, the HVAC system 150 determines that the HVAC system 150 should operate in the low load mode.

At block 302, the air temperature adjacent to the intake 154 is monitored. In particular, temperature of mixed air, which may include ambient air and return air, may be monitored to determine whether cooling is desired and that the low load mode of operation is suitable. As mentioned, the mixed air temperature may be above a temperature threshold in order for cooling by the HVAC system 150 to be desired. In some embodiments, the temperature of ambient air and/or the temperature of the air flow 152 returning from the conditioned space and entering the intake 154 may also be monitored to determine that the low load mode of operation is appropriate. These separate temperatures may be monitored by separate sensors. In some embodiments, at least one of the aforementioned temperatures may be detected above a corresponding temperature threshold in order for the low load mode of operation to be initiated and/or continued.

In addition to monitoring the air temperature adjacent to the intake 154, the air temperature adjacent to the output 164 may also be monitored, as shown at block 304. For example, the sensor 188 monitors the air temperature adjacent to the output 164, which may be indicative of a temperature of supply air provided by the HVAC system 150 to the conditioned space. The low load mode of operation may be initiated or continued when the temperature of the air flow 152 at the outlet 164 is greater than a temperature threshold, such as 13° C. In some embodiments, the temperature threshold may be selected or set based on a desired performance of the HVAC system 150 to reduce wear or degradation of components of the HVAC system 150.

When the respective air temperatures adjacent to the intake 154 and the output 164 are determined to be suitable for the low load mode, operation of certain HVAC system 150 components may be adjusted, as shown at block 306. In particular, operation of the compressor system 166 may be adjusted. As power may not be supplied to certain compressors 168, 170, and/or 172 in the low load mode of operation, such compressors 168, 170, and/or 172 may be disabled. For example, the first compressor 168 and the second compressor 170 may not be powered during the low load mode of operation.

However, the third compressor 172 may receive power to enable the third compressor 172 to continue to operate in the low load mode. In some embodiments, the third compressor 172 is a variable capacity compressor and during the low load mode, the third compressor 172 may operate at a particular capacity. The particular capacity may be a value, such as 1 tonne, or a percentage of the maximum capacity of the third compressor 172, such as 33%. The selected operating capacity may enable a more efficient operation of the compressor system 166 without placing undesired stress on the HVAC system 150. Additionally, a suction pressure cutout, or a minimum pressure threshold at which the refrigerant may enter the third compressor 172, may be adjusted, such as from 600 kilopascals (kPa) to 750 kPa for operation in the low load mode. The adjustment in suction pressure may adjust a temperature at which the refrigerant enters the third compressor 172 to enable the third compressor 172 to operate efficiently at low loads. For example, operation of the condenser 174, the expansion valve 175, and/or the evaporator 158 may be adjusted to achieve maintain a suction pressure of the refrigerant above the suction pressure cutout.

While operations of certain components of the HVAC system 150 are adjusted for the low load mode of operation, a remainder of the components of the HVAC system 150 may operate as under normal conditions, as indicated in block 308. That is, the components for which operation parameters are not adjusted for the low load mode of operation may continue to operate at normal conditions. For example, the economizer 156 may continue to operate as if not operating in a low load mode. In some embodiments, normal operations include triggering certain notifications, such as generating a system notification when certain operating parameters are not at or within desired values. For example, the voltage inputted to the VSD 182, the pressure of the refrigerant exiting the compressor system 166 and/or other operating parameters may be monitored, and a notification may be generated if one or more of the operating parameters are not at or within desired levels. In certain embodiments, the notifications are displayed adjacent to the HVAC system 150, and in additional or alternative embodiments, the notifications may be sent directly to external systems and/or certain individuals, such as for prompting maintenance. It should be understood that notifications may not be configured to send until the HVAC system 150 has reached a steady-state operation after initializing or changing an operating mode. For example, the notifications may not be configured to send until a certain has elapsed after the HVAC system 150 begins a particular, such as 5 minutes after initializing or changing an operating mode.

While the steps of block 262 describe the low load mode of operation for satisfying a cooling load, similar steps may be implemented for a low load mode of operation to satisfy a heating load. That is, the air temperatures at the intake 154 and the output 164 may still be monitored, operations of certain components of the HVAC system 150 may be adjusted, and operations of other components of the HVAC system 150 are performed according to normal operational modes. However, as should be understood, certain operating parameters may be changed. For example, instead of maintaining a temperature of air at the intake 154 above a certain threshold, the air temperature at the intake 154 may be monitored below a certain threshold to determine that heating is desired.

It should be appreciated that the method 250 and the detailed steps of block 262 may at least be partially performed by the controller 176. Steps not already mentioned may also be incorporated to either the method 250 and/or the steps of block 262. For example, the controller 176 may shut down the compressor system 166 when particular operating parameters are detected but not desired. In some embodiments, the HVAC system 150 may continue to operate, such as to provide unconditioned air flow 152, even though the compressor system 166 is disabled. Once shut off, the compressor system 166 may be disabled for a certain time, such as five minutes, before the compressor system 166 may be restarted to operate again. Moreover, operating parameters not already mentioned may also be monitored to determine suitable compatibility with the low load mode of operation, such as a pressure of the air flow 152 exiting the output 164.

As set forth above, embodiments of the present disclosure may provide one or more technical effects useful in the operation of HVAC systems. For example, an HVAC system may include a device configured to enable power supply to certain components of the HVAC system when an operating parameter is above a particular threshold in order to enable heating and/or cooling functions of the HVAC system. An operation of the HVAC system may be implemented such that, when the operating parameter has not met or exceeded the particular threshold, the HVAC system may continue to operate with heating and/or cooling capabilities in a low load mode of operation. In some embodiments, the device is configured to enable supply of power to compressors of the HVAC system, and during the low load mode, certain compressors may be disabled while a remaining portion of the compressors are configured to operate at adjusted operational settings. Furthermore, during the low load mode of operation, certain operating parameters are monitored to determine that conditions for the low load mode are maintained to reduce or prevent undesired stress on components of the HVAC system and/or to ensure that the components perform efficiently. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, mounting arrangements, use of materials, colors, orientations, and the like, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosed embodiments, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a first control comprising a switch configured to control a supply of power to a plurality of compressors by transitioning between an activation position based on an air flow through the HVAC system exceeding a first threshold and a deactivation position based on the air flow being below the first threshold; and a second control configured to supply power to a subset of compressors of the plurality of compressors based on the air flow through the HVAC system exceeding a second threshold while being below the first threshold.

2. The HVAC system of claim 1, wherein the switch is configured to supply power to the plurality of compressors in the activation position via a first circuit and the second control is configured to supply power to the subset of compressors via a second circuit.

3. The HVAC system of claim 2, wherein a portion of the first circuit is shared by the second circuit.

4. The HVAC system of claim 1, wherein the second control is configured to determine the air flow is below the first threshold based on the switch being in the deactivation position.

5. The HVAC system of claim 1, comprising a sensor system configured to measure the air flow.

6. The HVAC system of claim 5, wherein the sensor system is configured to provide a measurement of the air flow to the second control, which includes a controller comprising a tangible, non-transitory, computer-readable medium comprising computer-executable instructions that, when executed, are configured to cause a processor to determine whether the air flow exceeds the second threshold by comparing the measurement of the air flow to the second threshold.

7. The HVAC system of claim 5, wherein the sensor system comprises a sensing component of the switch configured to measure the air flow, and the switch is configured to transition between the activation position and the deactivation position based on the air flow measured by the sensing component.

8. The HVAC system of claim 1, wherein the subset of compressors has a variable capacity compressor.

9. The HVAC system of claim 8, wherein the second control comprises a controller comprising a tangible, non-transitory, computer-readable medium comprising computer-executable instructions that, when executed, are configured to cause a processor to operate the variable capacity compressor at a percentage of a maximum capacity of the variable capacity compressor when the switch is in the deactivation position.

10. The HVAC system of claim 1, wherein the second control is a controller comprising a tangible, non-transitory, computer-readable medium comprising computer-executable instructions that, when executed, are configured to cause a processor to operate the HVAC system in a disabled mode when the air flow is below the second threshold.

11. The HVAC system of claim 1, wherein the plurality of compressors is configured to circulate refrigerant through a refrigerant circuit of the HVAC system.

12. A controller comprising a tangible, non-transitory, computer-readable medium comprising computer-executable instructions that, when executed, are configured to cause a processor to:

determine a configuration of a control of a heating, ventilation, and/or air conditioning (HVAC) system, wherein the control is configured to enable power to be supplied to a plurality of compressors of the HVAC system in an activation configuration;

determine whether a parameter indicative of an amount of air flow through the HVAC system is above a threshold;

operate the HVAC system in a low load mode, in which power is supplied to a subset of compressors of the plurality of compressors, in response to a determination that the control is in a deactivation configuration and the parameter is above the threshold; and operate a blower of the HVAC system without supplying power to the plurality of compressors to direct air through the HVAC system while operation of the plurality of compressors is suspended in response to a determination that the control is in the deactivation configuration and in response to a determination that the parameter is below the threshold.

13. The controller of claim 12, wherein, in the low load mode, the computer-executable instructions, when executed, are configured to cause the processor to enable operation of a variable capacity compressor of the subset of compressors at a percentage of a maximum capacity of the variable capacity compressor.

14. The controller of claim 12, wherein the computer-executable instructions, when executed, are configured to cause the processor to monitor a first temperature of air flow entering the HVAC system in the low load mode and monitor a second temperature of the air flow exiting the HVAC system in the low load mode.

15. The controller of claim 12, wherein the computer-executable instructions, when executed, are configured to cause the processor to, in response to a determination that the control is in the activation configuration, operate the HVAC system in a normal operating mode.

16. The controller of claim 12, wherein the threshold is a first threshold, and the computer-executable instructions, when executed, are configured to cause the processor to determine whether the parameter is above a second threshold, wherein the second threshold is greater than the first threshold.

17. The controller of claim 16, wherein the computer-executable instructions, when executed, are configured to cause the processor to, in response to a determination that the control is in the deactivation configuration and in response to a determination that the parameter is above the second threshold, generate a flag identifier for the HVAC system.

18. The controller of claim 12, wherein the computer-executable instructions, when executed, are configured to cause the processor to determine if a cooling mode of operation of the HVAC system is desired, and operate the HVAC system in the low load mode in response to a determination that the control is in the deactivation configuration, the parameter is above the threshold, and the cooling mode of operation is desired.

19. A heating, ventilation, and/or air conditioning (HVAC) system, comprising:

a blower configured to direct an air flow through the HVAC system;

a sensor system configured to determine a parameter indicative of an amount of the air flow passing through the blower;

a variable capacity compressor; and a controller comprising a tangible, non-transitory, computer-readable medium comprising computer-executable instructions that, when executed, are configured to cause a processor to enable a first amount of power to be supplied to the variable capacity compressor based on the amount of the air flow being above a first threshold value, wherein the instructions, when executed, are configured to cause the processor to enable a second amount of power to be supplied to the variable capacity compressor based on the amount of the air flow being above a second threshold value and below the first threshold value, wherein the second amount of power enables the variable capacity compressor to operate at a percentage of a maximum capacity of the variable capacity compressor, and wherein the instructions, when executed, are configured to cause the processor to increase a suction pressure cutout of the variable capacity compressor.

20. The HVAC system of claim 19, wherein the blower is communicatively coupled to a motor configured to operate the blower, the motor is communicatively coupled to a variable speed drive configured to adjust a speed of the motor, and wherein the parameter comprises an amount of voltage supplied to the variable speed drive, a pressure differential across the blower, or both.

21. The HVAC system of claim 20, wherein the sensor system includes a switch configured to adjust between an activation position and a deactivation position based on the amount of voltage supplied to the variable speed drive, the pressure differential across the blower, or both, and wherein the instructions, when executed, are configured to cause the processor to enable the first amount of power to be supplied to the variable capacity compressor when the switch is in the activation position.

22. The HVAC system of claim 19, wherein the second threshold value and the first threshold value are determined via user input.

23. The HVAC system of claim 19, wherein the variable capacity compressor is configured to circulate refrigerant through a refrigerant circuit of the HVAC system, wherein the refrigerant circuit has an evaporator configured to place the refrigerant in thermal communication with the air flow, and wherein the refrigerant circuit has a condenser configured to remove heat from the refrigerant.

24. The HVAC system of claim 23, comprising an economizer, wherein the economizer is configured to remove heat from the air flow prior to the air flow entering the evaporator, and wherein the economizer is configured to remove heat from the refrigerant in the condenser.

25. A heating, ventilation, and/or air conditioning (HVAC) system, comprising:

a switch configured to transition between an activation position and a deactivation position based on an air flow through the HVAC system, wherein the switch is configured to control a supply of power to a plurality of compressors in the activation position; and a controller comprising a tangible, non-transitory, computer-readable medium comprising computer-executable instructions that, when executed, are configured to supply power to a subset of compressors of the plurality of compressors based on the switch being in the deactivation position, wherein the subset of compressors comprises a variable capacity compressor, and wherein the instructions, when executed, are configured to cause the processor to operate the variable capacity compressor at a percentage of a maximum capacity of the variable capacity compressor when the switch is in the deactivation position.

26. A heating, ventilation, and/or air conditioning (HVAC) system, comprising:

a blower configured to direct an air flow through the HVAC system;

a motor configured to operate the blower, wherein the motor is communicatively coupled to a variable speed drive configured to adjust a speed of the motor;

a sensor system configured to determine a parameter indicative of an amount of the air flow passing through the blower, wherein the parameter comprises an amount of voltage supplied to the variable speed drive, a pressure differential across the blower, or both, and wherein the sensor system comprises a switch configured to adjust between an activation position and a deactivation position based on the parameter; and a controller comprising a tangible, non-transitory, computer-readable medium comprising computer-executable instructions that, when executed, are configured to cause a processor to enable a first amount of power to be supplied to a compressor of the HVAC system based on the switch being in the activation position, and wherein the instructions, when executed, are configured to cause the processor to enable a second amount of power to be supplied to the compressor based on the switch being in the deactivation position.

* * * * *